US009433549B2

(12) United States Patent
Willemsen et al.

(10) Patent No.: US 9,433,549 B2
(45) Date of Patent: Sep. 6, 2016

(54) INCUBATOR

(71) Applicant: Babybloom Healthcare B.V., Leiden (NL)

(72) Inventors: Heleen Willemsen, Amsterdam (NL); Harald Nicolaas Laurentius Conneman, Rotterdam (NL); Richard Hendrik Marc Goossens, Vlaardingen (NL); Annemieke Geertje Christine van Boeijen, Delft (NL)

(73) Assignee: BABYBLOOM HEALTHCARE B.V., Leiden (NL)

( * ) Notice: Subject to any disclaimer, the term of this patent is extended or adjusted under 35 U.S.C. 154(b) by 220 days.

(21) Appl. No.: 14/221,881

(22) Filed: Mar. 21, 2014

(65) Prior Publication Data

US 2014/0296617 A1 Oct. 2, 2014

Related U.S. Application Data

(63) Continuation-in-part of application No. 12/135,523, filed on Jun. 9, 2008, now abandoned, which is a continuation-in-part of application No. PCT/NL2006/050311, filed on Dec. 8, 2006.

(30) Foreign Application Priority Data

Dec. 13, 2005 (NL) ..... 1030654

(51) Int. Cl.
*A61G 11/00* (2006.01)

(52) U.S. Cl.
CPC ..... *A61G 11/00* (2013.01); *A61G 11/002* (2013.01); *A61G 11/009* (2013.01)

(58) Field of Classification Search
CPC ... A61G 11/00; A61G 11/009; A61G 11/002
See application file for complete search history.

(56) References Cited

U.S. PATENT DOCUMENTS 3,809,065 A 5/1974 Gatts
3,858,570 A 1/1975 Beld et al.

(Continued)

FOREIGN PATENT DOCUMENTS

FR 2477869 9/1981
WO WO 03/030797 4/2003

OTHER PUBLICATIONS

Providing Comfort and Developmentally Supportive Care for Your Premature Baby by Susan L. Madden from the Preemie Parent's Companion: The Essential Guide to Caring for Your Premature Baby in the Hospital, at Home, and Through the first years (2000) . Accessed at http://www.prematurity.org/baby/supportivecare.html.*

(Continued)

*Primary Examiner* — Christine H Matthews
*Assistant Examiner* — Joshua D Lannu
(74) *Attorney, Agent, or Firm* — Peacock Myers, P.C.; Jeffrey Myers

(57) ABSTRACT

An incubator comprising a support and, mounted on the support, a patient-receiving unit provided with a cover, the cover being provided with means such as access openings for treating a patient, and wherein the patient-receiving unit is coupled with a heating element and/or a humidifying element via a conduit or conduits for heated and/or humidified air, which are equipped with a pump, wherein the pump, the heating element and/or the humidifying element are located in a foot of the support, and the conduit or conduits for heated and/or humidified air run between the foot and the patient-receiving unit, and in that the support is located substantially to one side of the patient-receiving unit, so as to leave a free legroom below the patient-receiving unit.

14 Claims, 7 Drawing Sheets

(56) References Cited

U.S. PATENT DOCUMENTS

| | | | | |
|---|---|---|---|---|
| 4,712,263 | A * | 12/1987 | Pronzinski | A61G 11/00 128/872 |
| 5,281,001 | A | 1/1994 | Bergsten et al. | |
| 5,453,077 | A * | 9/1995 | Donnelly | A61F 7/00 600/22 |
| 5,759,149 | A | 6/1998 | Goldberg et al. | |
| 6,213,935 | B1 * | 4/2001 | Mackin | A61G 11/00 600/22 |
| 6,409,654 | B1 | 6/2002 | McClain | |
| 2002/0072649 | A1 | 6/2002 | Costanzo et al. | |
| 2004/0034273 | A1 | 2/2004 | Boris | |

OTHER PUBLICATIONS

Bryant, "Crib Covers Create Restful Environment for Tiniest Patients", Critical Care Nurse, vol. 22, No. 5, Oct. 2002, 95-96.

* cited by examiner

INCUBATOR

CROSS-REFERENCE TO RELATED APPLICATIONS

This application is a continuation-in-part of U.S. patent application Ser. No. 12/135,523, filed on Jun. 9, 2008 which in turn is a continuation-in-part of Patent Cooperation Treaty (PCT) Application Serial No. PCT/NL2006/050311, entitled "INCUBATOR", to Technische Universiteit Delft, filed on Dec. 8, 2006 which claims priority to and the benefit of the filing of Netherlands Patent Application No. 1030654, entitled "INCUBATOR", filed on Dec. 13, 2005, and the specification and claims thereof are incorporated herein by reference.

BACKGROUND OF THE INVENTION

1. Field of the Invention

The invention relates to an incubator comprising a support and, mounted on the support, a patient-receiving unit provided with a cover, the cover being provided with means such as access openings for treating a patient, and wherein the patient-receiving unit is coupled with a heating element and/or a humidifying element via a conduit or conduits for heated and/or humidified air, which are equipped with a pump.

2. Description of Related Art

Such an incubator is known from the U.S. Pat. No. 5,453,077. The known incubator is not adjustable in height and is solid below the patient-receiving unit. Due to both these aspects of the prior art incubator, the nursing staff or other users of the incubator are unable to assume an ergonomic working posture.

From the German patent application DE 35 44 301 an incubator is known possessing a patient-receiving unit mounted on a support and provided with a cover.

At its lower side, the patient-receiving unit known from the German patent application DE 35 44 301 is provided with a control panel with which the amount of heated and/or humidified air that is introduced into the patient-receiving unit can be adjusted.

The incubators as known today, like the incubator known from the U.S. Pat. No. 5,453,077, exhibit the further problem that immediately below the patient-receiving unit a heating element and/or humidifying element is provided, as well as pumping means with which the heated and/or humidified air can be introduced into the patient-receiving unit. It is believed that young infants who are placed into the incubator, experience the sound from these nearby appliances as stressful. In premature babies, whose brain and body are still developing, this may lead to lifelong mental and physical problems. Likewise, noise from the surroundings may have a similarly negative influence.

As already mentioned above, there is also an ergonomic problem with the known incubator, because it is not easy to work at the incubator in a sitting position. An ergonomically optimal sitting position is also not possible with the incubator known from the German patent application DE 35 44 301. This is not only detrimental with regard to the working conditions of the nursing staff, but also the parents who try to make eye contact with the new-born baby and who, to enable them to do so, have to assume an unnatural posture. In order to make contact with their child, they often sit for hours near the incubator, with their bodies in uncomfortable positions. Parents often try to match the attitude of their head to that of their child's head, requiring them to turn their neck into an uncomfortable position. Parents, as well as nursing staff, complain of pain in the arms and shoulders when their arms are extended into the incubator for a long time.

A further problem concerns the fact that incubators are often situated in an environment that is illuminated for 24 hours a day, making it difficult for the patient in the patient-receiving unit to establish an adequate sleeping pattern.

From the U.S. Pat. No. 3,809,065 an incubator is known that comprises a patient-receiving unit positioned at a fixed height, mounted on a support, and wherein a pump and/or heating element is provided directly below the patient-receiving unit.

Although the distance between this pump/heating element and the patient receiving unit is larger than with the incubator known from the U.S. Pat. No. 5,453,077, the noise load is not optimal for the patient. In any case, the construction of this known Incubator is not designed to allow working at this incubator in an ergonomically responsible manner.

DETAILED DESCRIPTION OF THE INVENTION

The object of the invention is to remove the problems outlined above.

To this end the incubator according to the invention is characterised by one or several of the appended claims.

In a first aspect of the invention the incubator is characterised in that the pump, the heating element and/or the humidifying element are located in a foot of the support, and the conduit or conduits for heated and/or humidified air run between the foot and the patient-receiving unit, and in that the support is located substantially to one side of the patient-receiving unit, so as to leave a free legroom below the patient-receiving unit.

With the incubator according to the invention, two problems are solved at once, namely on the one hand the problem that the patient in the patient-receiving unit is disturbed by the noise generated by the incubator, and on the other hand that it is hardly possible to assume an ergonomic sitting and working position with the known incubator. By placing the pump in the foot of the support, the noise source is removed from the immediate vicinity of the patient-receiving unit so that its effect as noise source is reduced. Moreover, this placement in the foot of the support, In addition to the support being placed to one side of the patient-receiving unit, creates extra space below the patient-receiving unit, thereby providing better possibilities for assuming an economically responsible sitting or working position at the incubator. This Is further promoted by preferably also placing the heating element and the humidifying element in the foot of the support.

An additional advantage of the incubator proposed in accordance with the invention is that it is possible to move a bed, for example, for the mother of the new-born infant under the incubator. The mother is then able to make eye contact with the patient, without assuming an awkward reclining or sitting position.

For the improvement of one thing and another it is desirable for the patient receiving unit to be adjustable in height along the support. To this end it is advantageous for the conduit or conduits to be of a telescopic design.

In order to promote an ergonomically responsible posture during work it is further desirable for an armrest or arm rests to be provided beside the patient-receiving unit.

It is also advantageous for the armrest or arm rests to be able to swivel. This ability of the armrest or armrests to swivel may involve a horizontal or a vertical swivel movement.

In still another aspect of the invention, the incubator is characterised in that the support extends to beyond the patient-receiving unit, where it possesses a suspension member to which a light shade is fastened. By means of such a light shade it is possible at predetermined moments to exclude the ambient light from the incubator, so that the patient in the patient-receiving unit is not disturbed by ambient light.

For the sake of simplicity and the practicality of the facility just referred to, it is useful for the light shade to be adjustable in height and to be provided with a memory function for storing a selected position In which the light shade is placed.

It is further advantageous for the light shade to be manufactured in sound insulating and/or sound absorbing material. In this way the light shade is also functional as sound insulation against ambient noise.

Providing the light shade with a predetermined number of leaf-shaped cover elements, hingingly attached to the top side of the light shade serves its ease of use.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention.

Hereinafter, and without limiting the patent claims, the invention will be further elucidated by way of an exemplary embodiment and with reference to the drawing. The drawing shows in:

Identical reference numerals in the figures refer to similar parts.

DESCRIPTION OF THE PREFERRED EMBODIMENT

Figure 1:
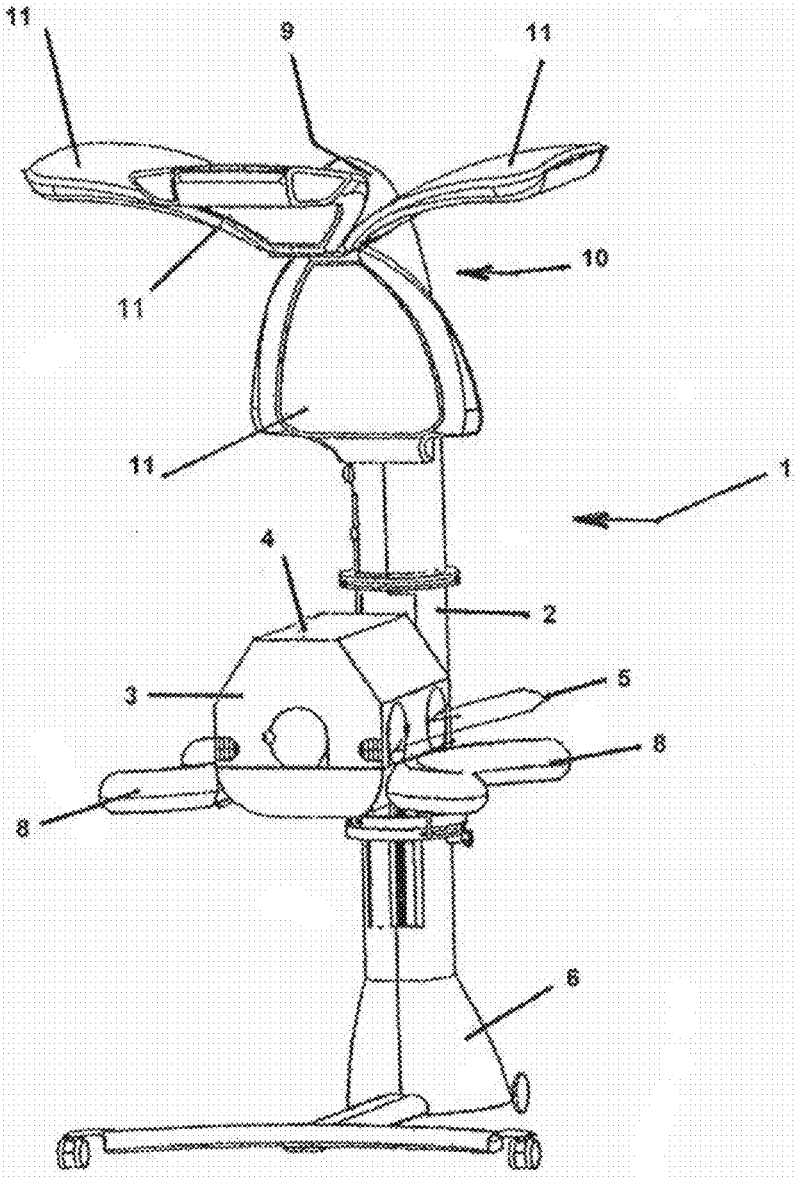
FIG. 1 the Incubator according to the invention in an oblique front view.

With reference first to FIG. 1, the incubator as proposed in accordance with the invention is shown.

The incubator carries reference numeral 1 and comprises a support 2 with a patient-receiving unit 3 mounted on the support 2 and provided with a cover 4, which is usually transparent.

In the usual manner, the cover 4 is provided with access openings 5 for treating a patient.

The support 2 is placed on a foot 6, which houses a pump and preferably also a heating element and/or humidifying element of the Incubator. A person skilled in the art is quite familiar with the appearance of a pump, a heating element and a humidifying element, and the person skilled in the art is also capable of envisaging how these components should be placed into the foot 6, rendering it unnecessary to actually show these elements in the figure.

The support 2, that is to say the portion of the support 2 that extends between the foot 6 and the patient-receiving unit 3, houses a conduit or conduits (supply and return pipes) for heated and/or humidified air whereby a coupling is provided between said patient-receiving unit 3 and the heating element and/or humidifying element provided in the foot 6.

Figure 2:
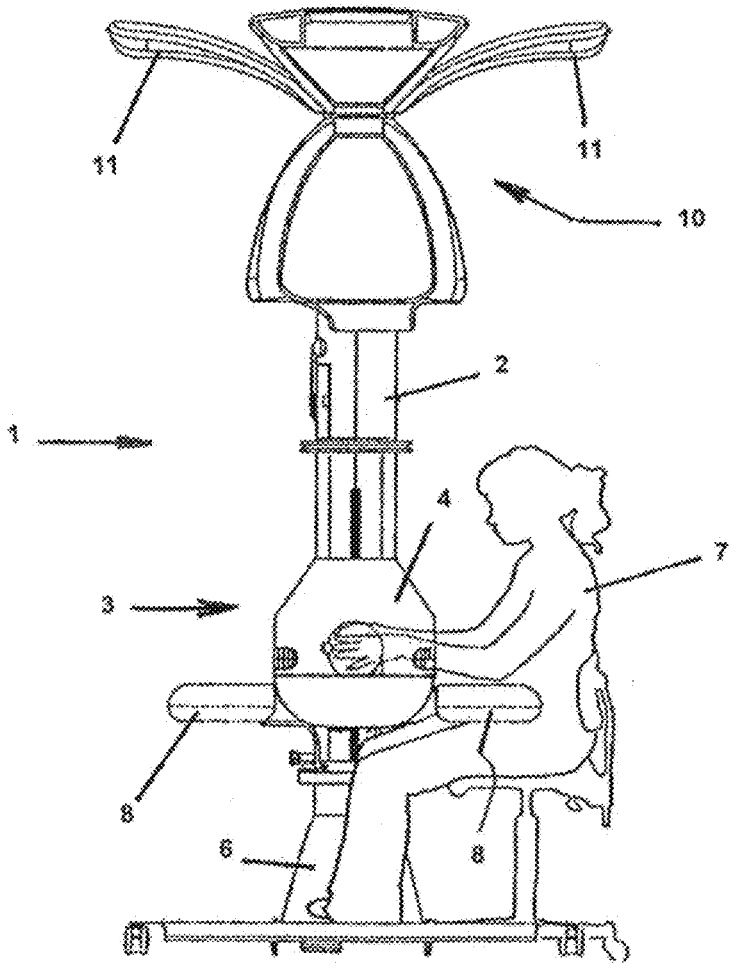
FIG. 2 a front view of the incubator according to the invention during use.

FIG. 2 shows that the incubator 1 according to the invention allows a nurse 7 to assume an ergonomic sitting posture. For this purpose, the support 2 is placed completely to one side of the patient-receiving unit 3, and is preferably also provided with arm rests 8, placed laterally to the patient-receiving unit 3 and below the access openings 5.

FIG. 1 and FIG. 2 also clearly show that viewed from both sides of the support 2, the cover 4 is provided with access openings 5 for treating the patient in the patient receiving unit 3. Furthermore, the cover may also be embodied without such openings and (sections thereof) may, for example, be liftable or hingeable.

Figure 3:
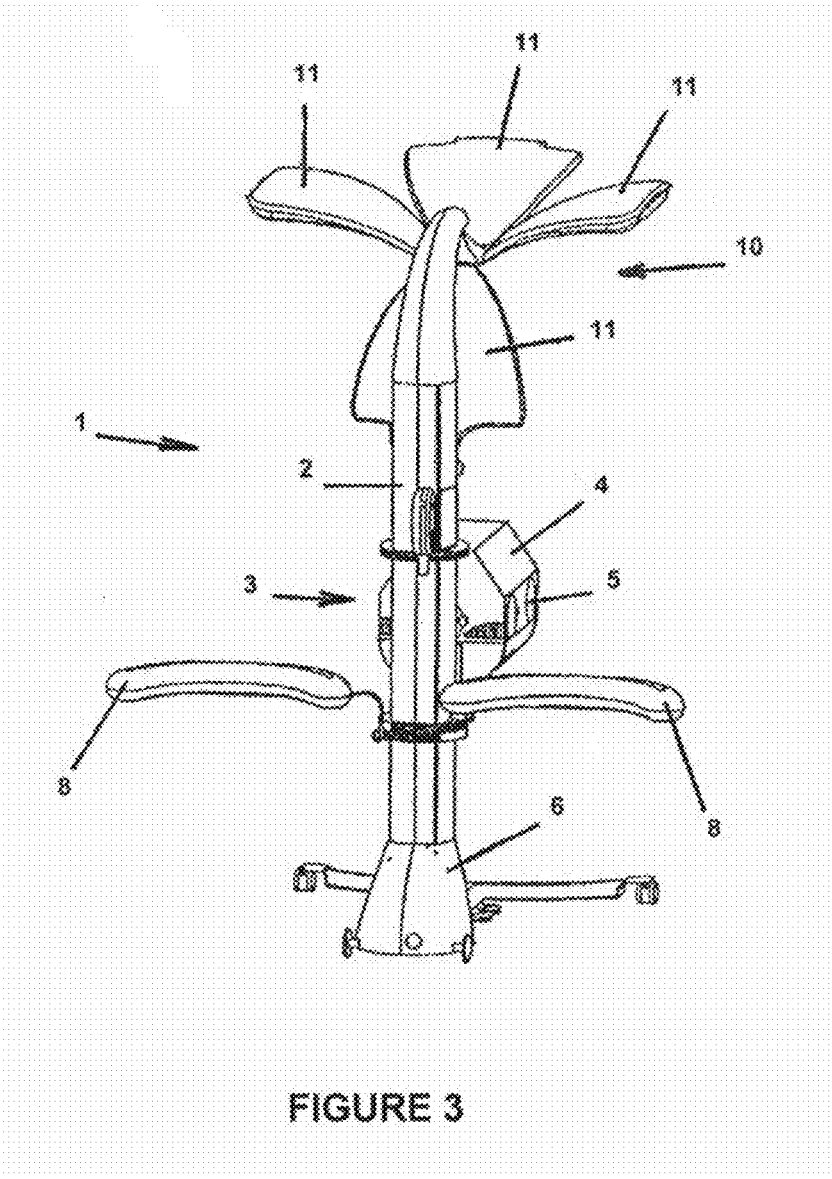
FIG. 3 a rear view of the incubator according to the invention.
Figure 4:
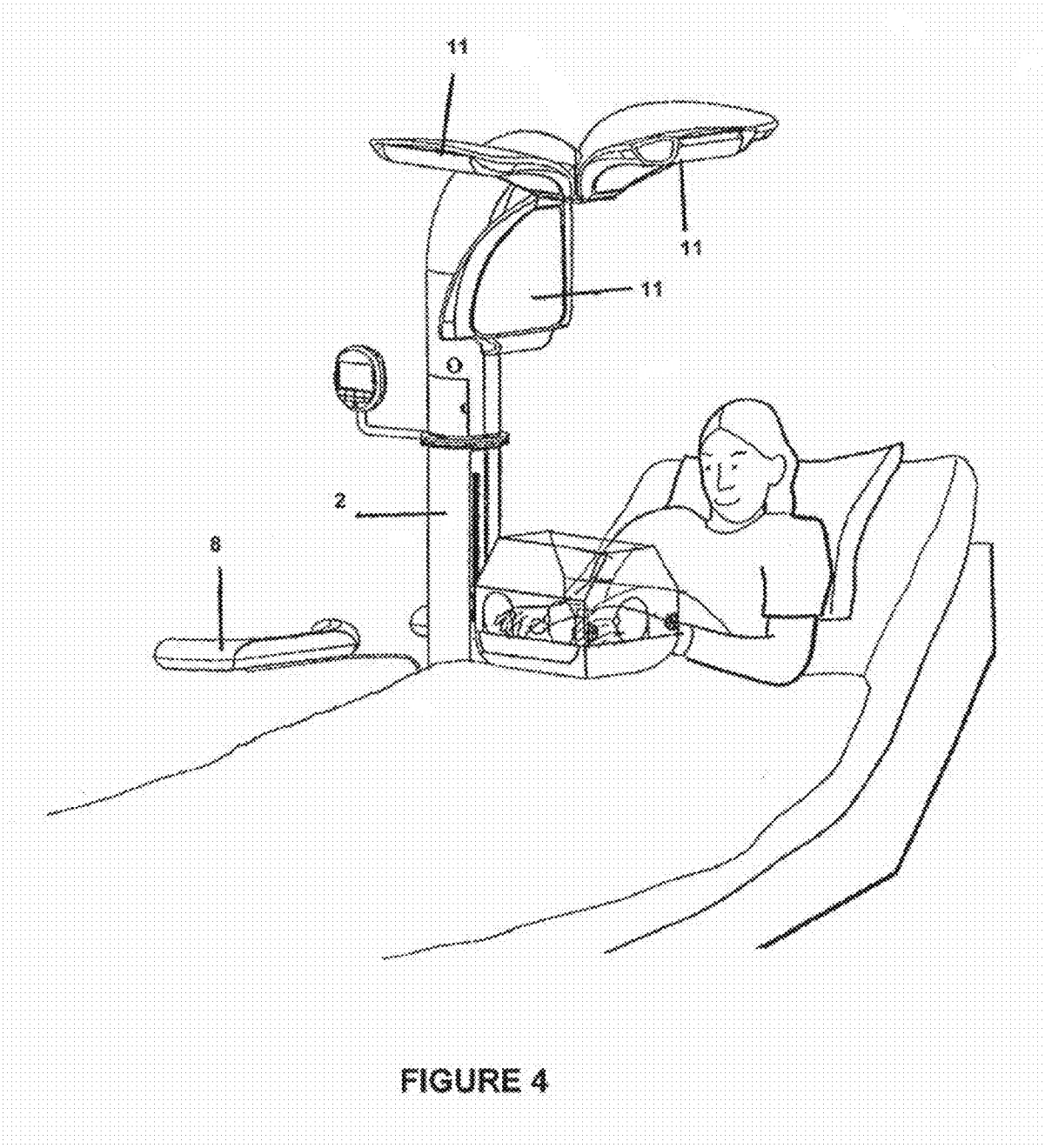
FIG. 4 the incubator according to the invention with a bed placed below it.

FIG. 3 shows the incubator 1 from the rear and indicates that the arm rests 8 are able to swivel in the horizontal plane around a vertical shaft, A further advantage is that the patient-receiving unit 3 is adjustable in height along the support 2, and that to this end the aforementioned conduit or conduits are of a telescopic design. This facilitates the positioning of a bed with, for example, the patient's mother, as shown in FIG. 4.

The various FIGS. 1-4 further show that the support 2 extends to beyond the patient-receiving unit 3, where it possesses a suspension member 9, to which a light shade 10 is fastened.

The FIGS. 1-4 show that this light shade 10 is provided with a predetermined number, in the illustrated case there are four, of leaf-shaped cover sections 11 that are hingingly attached at the top side of the light shade.

Figure 5:
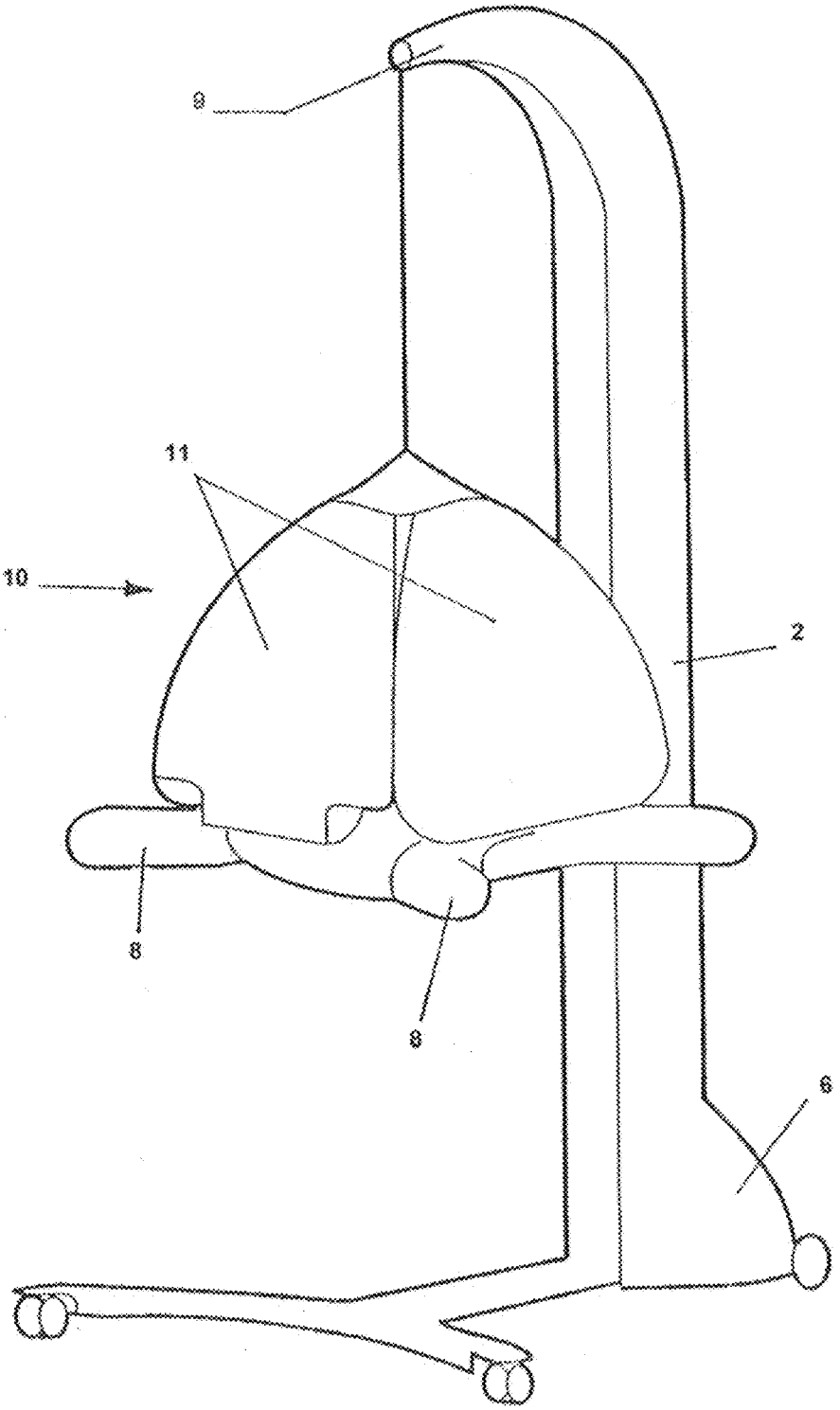
FIG. 5, the incubator according to the invention with the light shade covering the patient-receiving unit, FIGS. 6A and 6B a section of the light shade held in fully closed and fully open position by a gas spring, and FIG. 7 schematically a cross section of a multi-layer light shade section.

FIG. 5 shows the light shade 10 while the same is positioned over the patient receiving unit, with the leaf-shaped cover sections 11 hinged down.

The light shade 10 is preferably manufactured in sound-insulating material, so that apart from excluding light, the light shade 10 also has a sound damping function.

To position the light shade 10, it is desirable for it to be adjustable in height, as is apparent from the various figures, to which end it is preferably provided with a memory function for storing a selected position into which the light shade 10 has been adjusted at any time.

Figure 6A:
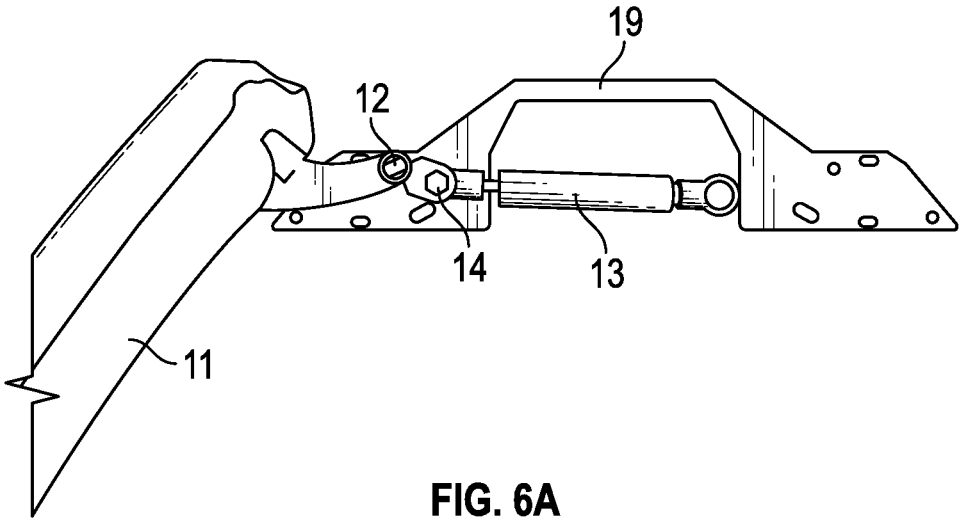
Figure 6B:
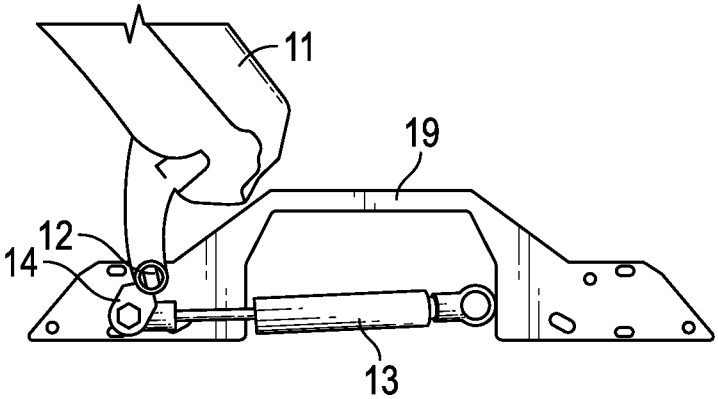

In FIGS. 6A and 6B is shown a top side 19 of the light shade, whereto a leaf shaped section 11 of the light shade 10 is mounted. For the sake of clarity only one shade section 11 is shown mounted to the top side 19, however the skilled person will readily conceive that on the opposite side (on the right side in the FIGS. 6A and 6B) a shade section 11 can be mounted in the same way, as well as on the front and rear sides of the sop side 19, which are not visible in this view. The section 11 is mounted by a hinge 12 to the top side 19. A gas spring 13 is connected to the shade section 11 by a lever 14. By means of the gas spring 13 the shade section 11 can be held in several different positions between fully closed (FIG. 6A) and fully opened (FIG. 6B). A memory function can be added for storing a selected position of the shade section 11, such that a preferred or desired position of the cover section can be readily retrieved, for example by pushing a memory button.

It must be understood that in the cross sectional view of FIGS. 6A and 6B only one hinge 12 and only one gas spring 13 is shown, but that along the length of the shade section 11 more than one hinges 12 and gas springs 13 can be present to mount the shade section 11 to the top side 19.

As a sound insulating material for the light shade 10, advantageously a foamed plastics material is used. In a preferred embodiment a leaf section 11 of the light shade 10 is formed as a multilayer part that has different layers of foamed plastic material. The different layers can have different properties such that sound in different frequency spectra can be absorbed by different layers. In this way the combination of the layers can be made such that an optimal sound insulating and absorption is achieved.

As materials foamed plastics can be used having an open- or a closed-cell structure. Open-cell structures generally have better sound absorption properties. Furthermore, foamed plastic may be used within a range of densities. In general higher density foams have better sound insulating properties. High frequencies are usually absorbed by open cell foam structures. Lower frequencies are usually reduced by high density foams.

Figure 7:
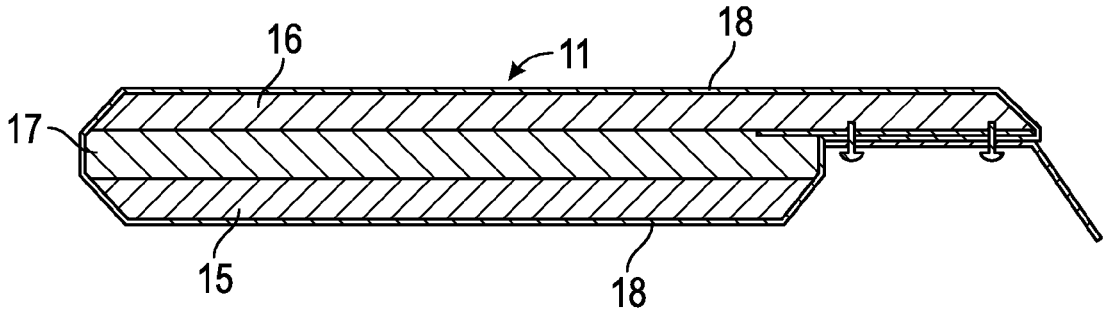

In a preferred embodiment the leaf shaped cover section 11 has a three-layer structure as is shown in FIG. 7. In an inner layer 15, that in a closed state of the cover section 11 faces the cover 4 of the patient receiving unit 3, a foam is used with a lower density and an open-cell structure. In this way sounds originating from the patient receiving unit 3 itself are best absorbed and not reflected. In an outer layer 16 a foam is used with a higher density, a higher rigidity. This outer layer 16 provides the structural strength and rigidity to the leaf shaped section 11. The outer layer 16 blocks a part of the sound coming from the environment. In an intermediate layer 17 located between the inner and outer layers 15, 16 a foam is used with complementary sound insulating an absorbing properties blocking another part of the sound coming from the environment.

The multiple layer structure of the leaf shaped section 11 is provided with a skin layer 18. The skin layer 18 is non porous and suitable for cleaning such that it meets hygiene standards applied in a medical environment.

What is claimed is:

1. An incubator comprising:

an upright support;

a patient receiving unit mounted to the support, said patient receiving unit including a patient supporting structure and a transparent cover positioned over a child supporting structure;

a light shade to be positioned on an outside over the transparent cover to shield the patient receiving unit from ambient light; and a suspension member located above the cover of the patient receiving unit and connected to the support, the light shade being fastened to said suspension member; and wherein the light shade comprises shade sections, said shade sections each being movable between a covering state to cover a part of the cover of the patient receiving unit and a non-covering state to uncover said part of the cover of the patient receiving unit; and wherein the shade sections include at least a layer formed of a foamed plastics material.

2. The incubator according to claim 1, wherein the light shade is height adjustable along the support.

3. The incubator according to claim 1, wherein the light shade has a top side attached to the suspension member, said shade sections being attached at said top side by hinging attachments allowing the movement of the shade sections between said covering state and non-covering state.

4. The incubator according to claim 1, wherein one or more of said shade sections are movable independently from the other shade sections.

5. The incubator according to claim 1, wherein the patient receiving unit and the light shade are adjustable in height along the support independently of each other.

6. The incubator according to claim 5, wherein the patient receiving unit and the light shade are interlockable so as to be adjustable in height together.

7. The incubator according to claim 1, wherein the shade sections include multiple layers of a foamed plastics material.

8. The incubator according to claim 7, wherein at least two of said multiple layers comprise a different foam structure.

9. The incubator according to claim 7, wherein said multiple layers comprise at least an inner layer that in use faces the cover of the incubator receiving unit and an outer layer that in use faces away from the cover of the incubator receiving unit.

10. The incubator according to claim 9, wherein the outer layer has a higher density than the inner layer.

11. The incubator according to claim 9, wherein the inner layer has a lower density than the outer layer.

12. The incubator according to claim 9, wherein the outer layer has the highest rigidity of all the layers of a multilayer structure.

13. The incubator according to claim 1, wherein the shade sections have a surface skin layer.

14. The incubator according to claim 11, wherein the foam structure has an open cell structure or a closed cell structure.

* * * * *